US006745912B2

(12) United States Patent
Uehara et al.

(10) Patent No.: US 6,745,912 B2
(45) Date of Patent: Jun. 8, 2004

(54) ARTIFICIAL NIPPLE AND A FEEDING BOTTLE HAVING THE ARTIFICIAL NIPPLE

(75) Inventors: Hiroyuki Uehara, Tokyo (JP); Aki Ishimaru, Tokyo (JP); Masayuki Nakahara, Tokyo (JP); Zenichi Onuki, Tokyo (JP)

(73) Assignee: Pigeon Corporation, Tokyo (JP)

( * ) Notice: Subject to any disclaimer, the term of this patent is extended or adjusted under 35 U.S.C. 154(b) by 0 days.

(21) Appl. No.: 10/288,523

(22) Filed: Nov. 6, 2002

(65) Prior Publication Data

US 2003/0089676 A1 May 15, 2003

(30) Foreign Application Priority Data

Nov. 9, 2001 (JP) ..... 2001-344594
Aug. 30, 2002 (JP) ..... 2002-255221

(51) Int. Cl.[7] ..... A61J 11/00; A61J 9/00
(52) U.S. Cl. ..... 215/11.1
(58) Field of Search ..... 215/11.1–11.6; 426/117

(56) References Cited

U.S. PATENT DOCUMENTS 589,212 A * 8/1897 Michael ..... 215/11.1
605,161 A * 6/1898 Clement et al. ..... 215/11.1
633,343 A * 9/1899 Heany ..... 215/11.1
1,590,152 A * 6/1926 Dreyfus ..... 215/11.1
2,588,069 A * 3/1952 Allen ..... 215/11.1
5,101,991 A * 4/1992 Morifuji et al. ..... 215/11.1
5,544,766 A * 8/1996 Dunn et al. ..... 215/11.1
5,673,806 A * 10/1997 Busnel ..... 215/11.1
6,161,710 A * 12/2000 Dieringer et al. ..... 215/11.4

FOREIGN PATENT DOCUMENTS

JP 02264660 A * 10/1990 ..... A61J/11/00
JP 05115535 A * 5/1993 ..... A61J/11/00

* cited by examiner

*Primary Examiner*—Sue A. Weaver
(74) *Attorney, Agent, or Firm*—The Kenealy Law Office, L.L.C.

(57) ABSTRACT

This invention provides an artificial nipple 210*a*. The artificial nipple comprises: a nipple portion 212*a* having a first curved surface, whose tip is provided with an opening portion 216*a*; a nipple body portion 211*a* formed on the nipple portion 212*a*, having a second curved surface, wherein the second curved surface of the nipple body portion 211*a* is continuously extended from the first curved surface of the nipple portion 212*a*, and wherein the second curved surface of the nipple body portion 211*a* is significantly expanded as a part of the second curved surface goes away from the nipple portion 212*a*; and a base portion 214*a* formed on the nipple body portion, wherein the base portion 214*a* is capable of being attached to a container to house a drink. According to the present invention, the nipple body portion 211*a* has a maximum outer diameter of 30 mm or more. According to the present invention, the nipple portion 212*a*, measured by placing the base portion 214*a* of the artificial nipple 210*a* on a precise universal tester having a metallic pressing top made of a cylindrical shape with a radius of about 5 mm, to compress the maximum outer diameter of the nipple portion into the direction of the center thereof, has a nipple elasticity of 0.1 N to 0.8 N when the maximum outer diameter of the nipple portion is compressed by 20%, and of 1.0 N to 2.5 N when the maximum outer diameter of the nipple portion is compressed by 60%.

11 Claims, 15 Drawing Sheets

FIG. 7

| | Hardness | Maximum Outer Diameter (mm) | Thickness (mm) | Width (mm) | Starting to pressing — Amount of the Pressing 20% | 30% | 40% | 50% | Ending to pressing 60% |
|---|---|---|---|---|---|---|---|---|---|
| Example 1 | 15±5 | 38.6 | 2.0 | 13.0 | 0.64 | 1.03 | 1.39 | 1.75 | 2.26 |
| Example 2 | 15±5 | 38.6 | 2.0 | 13.0 | 0.58 | 1.00 | 1.36 | 1.81 | 2.22 |
| Example 3 | 15±5 | 38.6 | 2.0 | 13.0 | 0.47 | 0.81 | 1.14 | 1.49 | 1.91 |
| Example 4 | 20±2 | 38.6 | 1.6 | 13.0 | 0.73 | 1.06 | 1.35 | 1.70 | 2.14 |
| Comparative 1 | 35 | 38.0 | 1.0 | 12.5 | 1.16 | 1.73 | 2.19 | 2.60 | 3.34 |
| Comparative 2 | 43 | 37.5 | 1.3 | 14.0 | 1.07 | 1.54 | 1.94 | 2.31 | 2.77 |
| Comparative 3 | 45 | 50.0 | 1.5 | 13.5 | 1.70 | 2.54 | 3.41 | 4.56 | 6.10 |
| Comparative 4 | 47 | 38.0 | 1.7 | 13.3 | 2.16 | 3.45 | 4.35 | 5.61 | 8.05 |
| Comparative 5 | 33 | 27.8 | 1.7 | 14.0 | 0.98 | 1.10 | 1.89 | 2.38 | 2.97 |
| Comparative 6 | 35 | 27.5 | 1.3 | 13.0 | 0.82 | 1.2 | 1.59 | 1.87 | 2.18 |

(Unit:N)

FIG. 10

The amount of variation of the nipple elasticity, when the amount of the deformation is changed by 10%

| | The amount of variation of the nipple elasticity, when the amount of the deformation is changed by 10% (N) | | | |
|---|---|---|---|---|
| | 30–20 (%) | 40–30 (%) | 50–40 (%) | 60–50 (%) |
| Example 1 | 0.39 | 0.36 | 0.36 | 0.51 |
| Example 2 | 0.42 | 0.36 | 0.45 | 0.41 |
| Example 3 | 0.34 | 0.33 | 0.35 | 0.42 |
| Example 4 | 0.33 | 0.30 | 0.35 | 0.43 |
| Comparative 1 | 0.57 | 0.46 | 0.41 | 0.74 |
| Comparative 2 | 0.47 | 0.40 | 0.37 | 0.46 |
| Comparative 3 | 0.84 | 0.87 | 1.15 | 1.54 |
| Comparative 4 | 1.29 | 0.90 | 1.26 | 2.44 |
| Comparative 5 | 0.12 | 0.79 | 0.49 | 0.59 |
| Comparative 6 | 0.38 | 0.39 | 0.28 | 0.31 |

ARTIFICIAL NIPPLE AND A FEEDING BOTTLE HAVING THE ARTIFICIAL NIPPLE

TECHNICAL FIELD OF THE INVENTION

The present invention relates to an artificial nipple used, for example, when an infant and the like are nursed. The present invention also relates to a feeding bottle having the artificial nipple.

BACKGROUND OF THE INVENTION

Artificial nipples are generally attached to a container such as a feeding bottle housing, for example, milk housed therein, and are used for nursing infants and the like.

Conventional artificial nipples as such have a construction as shown in FIG. 14. FIG. 14 is a cross sectional view of a conventional artificial nipple 10.

As shown in the drawing, there is an artificial nipple 10 having a hollow portion A, through which, for example, milk housed in a container such as a feeding bottle, can flow. Also, the artificial nipple 10 is provided with a nipple portion 12, nipple body portion 11 and base portion 13, said portions being formed in such a manner as to cover the above mentioned hollow portion A. These portions are made of silicone rubber, isoprene rubber, and so on.

In addition, the nipple portion 12 is provided with an opening 12*a*, out of which milk, and the like, may be spouted out. Such an artificial nipple 10 is designed to be fitted to a container such as a feeding bottle. Then, milk, and the like, housed in a container such as a feeding bottle, are fed to the infant, via the artificial nipple 10. Here, the feeding bottle, and the like, is not shown in the drawings.

By the way, an infant 20, in fact, takes hold of the breast of, for example, his or her mother in his or her mouth to swallow or drink the milk. The movement of the infant 20 when holding the breast of, for example, his or her mother to swallow or drink the milk, the infant 20 moves his or her mouth by two steps roughly classified as follows: "step to prepare sucking" and "step to start sucking". Each of the steps is explained as follows.

Step to Prepare Sucking

FIG. 15 is a view for describing the overview of the "step to prepare sucking".

As shown in the FIG. 15, when an infant 20 holds the breast 30 of his or her mother, and so on, in the mouth, the infant largely opens his or her upper and lower lips 27*a*, 27*b*. Then, the infant extends his or her tongue 23 over the lower tooth bank 28*b*, resulting in a condition where the tongue touches the lower lip 27*b*.

Then, the infant holds the breast in his or her mouth. At that time, the infant 20 largely opens his or her upper and lower lips 27*a*, 27*b*. The upper and lower lips 27*a*, 27*b* are very soft and easily transformed as shown in FIG. 15. Therefore, when the infant tightly contacts the upper and lower lips 27*a*, 27*b* at the breast 30, in particular, a breast circle 31, they 27*a*, 27*b* are opened in such a manner as to naturally roll them up or down in the vertical direction of the drawing.

In addition, an infant 20 transforms his or her tongue 23 to transport the tip 32*a* of the nipple of mother, and the like, into the deepest point of his or her mouth roof cavity 22. The movement that an infant 20 extends his or her tongue to transport the tip 32*a* of the nipple into his or her mouth roof cavity 22, as stated here, is generally referred to as "the first elongation."

The nipple 32, in a condition of "the first elongation" described above, is compressed, by tongue 23, against his or her upper palate 21, upper tooth bank 28*a* and upper lip 27*a*, as shown in FIG. 15. At that time, the whole of the nipple 32 is also surrounded by the inside of his or her cheeks and the tongue 23.

In particular, the tongue 23, surrounding the nipple 32, transforms for holding the nipple 32 completely. The nipple 32 is a non-hollow organization. When the nipple 32 is transformed, the mother's milk is transferred to the tip 32*a* thereof without the nipple 32 being terminally crushed.

As stated above, the "step to prepare sucking" is finished.

Step to Start Sucking

Then, the "step to start sucking" will be explained. First of all, the infant moves his or her tongue 23 in a peristaltic manner, at the stage of "step to start sucking".

In other words, the infant stimulates the breast 30, areola 31 and nipple 32 to promote his or her mother to secrete mother's milk as well as to transfer the mother's milk up to the tip of the nipple 32. Here, the tongue 23 moves in such a manner that an expansion of the tongue 23 continuously moves from the tip portion of the tongue to the root portion thereof. Then, such expansion further moves to a portion of the tongue just beyond the tip 32*a* of the nipple followed by transferring to a deep portion of the mouth.

Such movement of the expansion is shown in FIGS. 16 (*a*) to (*c*). FIGS. 16 (*a*) to (*c*) show magnified views for describing the overview, in relation between the tongue 23 and the tip 32*a* of the nipple, showing a sequence of the peristaltic movement where the expansion of the tongue 23 just goes beyond the tip 32*a* of the nipple and further goes to the deep portion of the mouth.

Thus, the nipple 32 is elongated by the transferring of the expansion of the tongue 23, from the tip thereof to the root thereof. Also, the tip 32*a* of the nipple is a non-hollow organization, and the nipple may be extended in the direction of the tip thereof, while the nipple is deformed in a slightly crushed manner as shown in FIG. 16(*a*). As shown in FIG. 16(*b*), when the expansion of the tongue 23 moves in a peristaltic manner, the nipple 32 is extended just before mother's milk spouts out.

The step stated here is referred to as the "second elongation," which is distinguished from the "first elongation" as mentioned above. Thus, the "second elongation" starts when the tongue 23 moves the expansion, beginning at the tip of the tongue.

Next, there comes a step in which the mother's milk is squirted out. Generally, the infant transforms the tongue 23 to move the expansion so as to draw the nipple of mother, and the like, toward the tip 32*a* of the nipple. Then, the expansion of the tongue 23 moving in a peristaltic manner reaches at the tip portion of the tip 32*a*, so as to form a sealed space E surrounded by the tip 32*a* of the nipple, the expanded tongue 23, an inner part of the mouth roof cavity 22, and the soft palate 24 located inside the mouth roof cavity 22.

Then, the tongue 23 contacts the soft palate 24, during which the movement in a peristaltic manner further continues to transfer the expansion of the tongue 23 into the deeper portion of the mouth. Then, as shown FIG. 16 (*b*), the capacity of the sealed space E increases or grows, and thereby, a decreased pressure is generated inside the sealed space E.

When there is formed a sealed space having a decreased pressure as such, the tip 32*a* of the nipple is drawn into the sealed and decreased pressure space E, resulting in further elongating the tip 32*a* of the nipple. When the elongation as such is accomplished, the "second elongation" is finished.

By moving the tongue 23 in a peristaltic manner resulting in generating the decreased pressure, the mother's milk, gathering at the tip 32*a* of the nipple, spouts out into the mouth of the infant 20. Then, the infant 20 releases the tongue 23 from the soft palate 24 and opens the sealed space E, and then, the infant 20 may swallow or drink the mother's milk that has been squirted out, as shown in FIG. 16 (*c*).

After the "first elongation" is finished, the infant 20 repeats the "second elongation" in a rapid cycle of once per 0.7 seconds, so as to drink the mother's milk of, for example, his or her mother, as stated above.

OBJECTIVES OF THE INVENTION

When the mother, and so on, breast-feeds an infant 20, the infant 20 drinks the mother's milk in the manner as described above, via the nipple of his or her mother, and so on. Similarly, when formula of artificial milk that is not the mother's milk is fed to the infant 20, the infant 20 takes the same sucking behavior as described above. Therefore, an artificial nipple 10 imitates the appearance of the mother's nipple as shown in FIG. 14, and is installed on a feeding bottle so as to nurse an infant 20.

The nipple part 12 of the conventional artificial nipple 10, as shown in the FIG. 14, has a length, in the horizontal direction in FIG. 14, longer than that of the nipple of mother, and the like. This is because the artificial nipple 10 is, in advance, designed to correspond to the length in a condition of the "first elongation" in the course of the "step to prepare sucking" as mentioned above, shown in FIG. 15.

However, such a nipple portion 12 of the conventional artificial nipple 10, as shown in FIG. 14, has some of the following problems.

That is, an infant 20, at the "step to prepare sucking" as mentioned above, holds the artificial nipple 10 in his or her mouth, and then, he or she transforms the nipple portion 12 by using his or her tongue 23 so as to place the tip of the nipple portion 12 at the deepest point in the mouth roof cavity 22, as shown in FIG. 16.

However, the artificial nipple 10 may sometimes be insufficient in elasticity, so that an infant, and so on, may find it difficult to transform up the tip of the nipple portion by the tongue 23, resulting in a situation in which the infant 20 may not move the tongue 23 in a peristaltic manner nor form a sealed space E as shown in FIG. 16(*a*). Further, when an artificial nipple 10 is hard, it is difficult for an infant to smoothly move the tongue 23 in a peristaltic manner. Furthermore, if the nipple portion 12 is hard, the nipple portion 12 may not be transformable in an upward or downward direction, in terms of deformation, resulting in a situation in which it is difficult to form the sealed space E.

Further, even if an infant 20 moves his or her tongue 23 in a peristaltic manner, it may be difficult to transform the nipple portion 12 of the artificial nipple 10, in accordance with the above mentioned "second elongation" as shown in FIG. 16 (*a*), resulting in difficulty in obtaining the sealed space E. Accordingly, it may be difficult to generate a decreased pressure in the sealed space E even if transferring the expansion of the tongue 23, and thereby, it is difficult for the infant 20 to swallow or drink formula, since the formula, gathered near the tip of the nipple portion 12, is difficult to spout out.

In solving the above-mentioned problems, there may be an alternative way to make an artificial nipple 10 made of a soft material. Such alternative way focuses on an improvement of a condition where an infant holds the artificial nipple 10 in his or her mouth to locate it in the mouth roof cavity 22, or where it makes easy to transform the nipple portion at the second elongation. However, such alternative way will cause another problems that when an infant 20 moves his or her tongue 23 in a peristaltic manner as described above, the nipple portion, made of soft material, may be completely deformed so as to clog the inner space A. Accordingly, it will be difficult for the formula, and the like, to flow to the opening 12*a* of the nipple portion 12, and thereby, the infant 20 will have difficulty in drinking or swallowing formula and the like.

Furthermore, in addition to the difficulties as stated above, if such an artificial nipple 10 is continuously used by an infant 20 and the infant 20 becomes accustomed to move his or her mouth, he or she may acquire a skill of drinking the formula, and the like, even from such artificial nipple. However, such an ability will adversely affect and confuse the infant when he or she is breast-fed by the nipple of his or her mother, and the like.

Accordingly, there are objectives of the present invention, in consideration of the above-mentioned problems. That is, it is necessary to provide an artificial nipple, which may be transformed and elongated appropriately when an infant moves his or her tongue in a peristaltic manner, such that it behaves in the same manner as the nipple of the mother, and so on. Also, there is an objective to provide an artificial nipple that does not squirt out liquid in an inferior manner, due to deforming the artificial nipple and intermittently interrupting the flowing path. Also, there is an objective to provide a feeding bottle provided with the artificial nipple according to the present invention.

BRIEF DESCRIPTION OF THE DRAWINGS

FIG. 7 is a table showing various conditions and results of the prepared samples to be measured by the precise universal tester as shown in FIG. 1.

FIG. 10 is a table showing a varied quantity of nipple elasticity when a deformed quantity is varied by 10%.

According to claim 1 of the present invention for solving the above mentioned objectives, there is provided an artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to house a drink, wherein the nipple body portion has a maximum outer diameter of 30 mm or more, and wherein the nipple portion, measured by placing the base portion of the artificial nipple on a precise universal tester having a metallic pressing top made of a cylindrical shape with a radius of about 5 mm, to compress the maximum outer diameter of the nipple portion into the direction of the center thereof, has an nipple elasticity of 0.1 N to 0.8 N when the maximum outer diameter of the nipple portion is compressed by 20%, and of 1.0 N to 2.5 N when the maximum outer diameter of the nipple portion is compressed by 60%.

Figure 15:
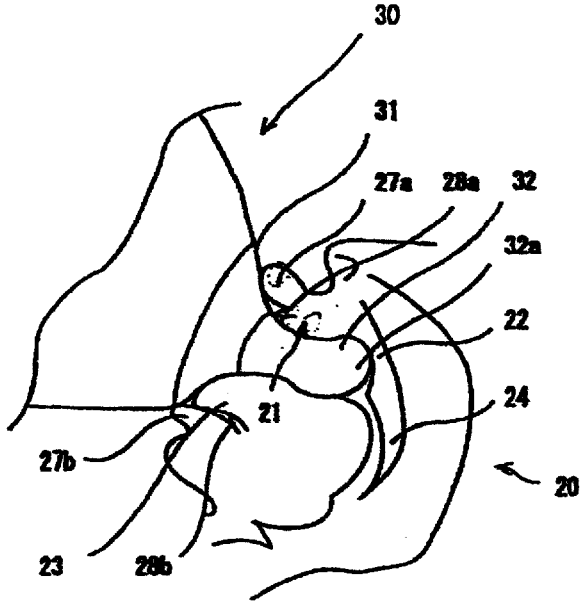
FIG. 15 is a view for explaining the overview of the "step to prepare sucking".

By compressing the maximum outer diameter of the nipple portion by 20%, the nipple elasticity obtained at that time indicates the extent of softness, when an infant, and the like, "transform" the nipple portion to contact the top thereof at the deepest point in his or her own mouth roof cavity by the tongue as shown in FIG. 15, or when an infant, and the like, start to move his or her tongue in a peristaltic manner, as described in the "step to prepare sucking."

Also, by compressing the maximum outer diameter of the nipple portion by 60%, the nipple elasticity obtained at that time indicates the extent to which the nipple can tolerate the transformation generated, when an infant, and the like, elongate or transform the nipple portion by moving his or her tongue in a peristaltic manner, as well as the degree of hardness or elasticity without being completely deformed, in the above-mentioned "second elongation" in the step to start sucking."

Provided that the artificial nipple has a nipple elasticity between 0.1 N and 0.8 N when the maximum outer portion of the nipple portion is compressed by 20%, an infant, and the like, when holding the artificial nipple in his or her mouth, may "transform" the nipple portion of the artificial nipple so as to contact the deepest point of his or her own mouth roof cavity. The "transformation" of the nipple portion corresponds to the "transformation" at stage of the "step to prepare sucking."

Similarly, the movement of the tongue in a peristaltic manner may not be interrupted in case of the "second elongation", and it may also be carried out smoothly.

Therefore, an infant, and the like, may contact the nipple portion at his or her own mouth roof cavity and smoothly move his or her tongue in a peristaltic manner. Accordingly, there is obtained a nipple portion according to the present invention that can be extended in such a manner, and thereby, an infant, and the like, may easily move the tongue in a peristaltic manner.

Also, the compression rate, obtained when the maximum outer diameter portion of the nipple portion is compressed by 60%, shows that according to the present invention, it is easy for an infant, and the like, to move his or her tongue in a peristaltic manner during the "second elongation," and that the nipple portion avoids squirting out liquid in an inferior manner caused by the nipple portion being deformed such that the flowing path thereof is closed off.

Where the nipple elasticity is at a range between 1.0 N and 2.5 N, it may be easy fir the infant to move his or her tongue in a peristaltic manner, and also, the nipple portion is prevented from being completely deformed such that the flowing path thereof is closed off.

Therefore, the nipple portion according to the present invention of claim 1, having a maximum outer diameter portion of the nipple portion having a nipple elasticity of 1.0 N to 2.5 N when compressed by 60% in the nipple compression rate, makes it easy for an infant, and the like, to smoothly move his or her tongue in a peristaltic manner.

Especially, if the maximum outer diameter of the nipple portion is compressed by 60%, there may be easily occurred deformation to the extent that the flowing path is closed off, accompanied by movement of the tongue in a peristaltic manner, if the nipple elasticity is less than 1.0 N. On the other hand, if the nipple elasticity exceeds 2.5 N, the nipple portion, and especially, the top thereof, generally may not be transformed in the vertical direction of the nipple portion even when an infant, and the like, move in a peristaltic manner of the tongue, and the nipple portion generally continues to stay in a ball shape, which interrupts him or her to move the tongue in a peristaltic manner. According to claim 1 of the present invention, there may be provide an artificial nipple for avoiding such a problem.

Furthermore, the nipple body portion has a maximum outer diameter portion of 30 mm or more, which is a comparatively bigger outer diameter than conventional ones. Also, the maximum outer diameter portion of the artificial nipple may allow a large and smooth movement of the tongue in a peristaltic manner, by the above mentioned nipple elasticity. Therefore, it may be possible for an infant, and so on, to suck in a similar manner of sucking from the nipple of mother, and so on.

According to claim 2 of the present invention for solving the above mentioned objectives, there is provided an artificial nipple comprising:

a nipple portion having a first curved surface, whose top is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to house a drink, wherein the nipple body portion has a maximum outer diameter of 30 mm or more, and wherein the nipple portion is composed of an elastic material having a hardness of 5 to 25 degrees, and wherein the nipple portion has a thickness in the direction of the center thereof, at the maximum outer diameter portion of the nipple portion, of 1.5 mm or more.

According to claim 2 of the invention, the nipple body portion of the artificial nipple has a maximum outer diameter of 30 mm or more, and the nipple portion is made of elastic material having a hardness of 5 to 25 degrees, and the maximum outer diameter portion of the nipple portion has a thickness in the radius direction of 1.5 mm or more.

Such a construction of the artificial nipple has a degree of softness that allows an infant, and so on, to easily move his or her tongue so as to "transform" the top of the nipple portion, and thereby contact it at the deepest point in the mouth roof cavity, at the stage of the "step to prepare sucking as shown in FIG. 15. Similarly, such construction also allows the tongue to smoothly move in a peristaltic manner.

In other words, according to the present invention, an infant, and so on, may "transform" the nipple portion of the artificial nipple to contact it at the deepest point of the mouth roof cavity so as to move the tongue in a peristaltic manner, even by weak force of the infant, and so on.

Furthermore, the artificial nipple according to claim 2 is soft to the extent that the tip of the nipple is prevented from continuing a half ball shape without transformation, which is similar to the case of claim 1.

Also, at the stage of the "second elongation" of the "step to prepare sucking" as stated above, the artificial nipple has a hardness sufficient to allow an infant, and so on, to easily elongate or transform the nipple portion by a peristaltic manner movement of the tongue, as well as sufficient to prevent any liquid from inferiorly spouting in an inferior manner due to the nipple portion being completely deformed.

According to claim 3 of the present invention for solving the above mentioned objectives, there is provided a feeding bottle comprising:

a container to house a drink;

an artificial nipple attached to the container; the artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is attached to the container to house a drink, wherein the nipple body portion has a maximum outer diameter of 30 mm or more, and wherein the nipple portion, measured by placing the base portion of the artificial nipple on a precise universal tester having a metallic pressing top made of a cylindrical shape with a radius of about 5 mm, to compress the maximum outer diameter of the nipple portion into the direction of the center thereof, has an elasticity of 0.1 N to 0.8 N when the maximum outer diameter of the nipple portion is compressed by 20%, and of 1.0 N to 2.5 N when the maximum outer diameter of the nipple portion is compressed by 60%; and a fixing portion for fixing the artificial nipple at the container.

According to the construction of claim 3, there is provided a feeding bottle provided with the artificial nipple functioning and having the effect, and so on, defined in claim 1.

According to claim 4 of the present invention for solving the above mentioned objectives, there is provided a feeding bottle comprising:

a container to house a drink;

an artificial nipple attached to the container; the artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to accommodate a drink, wherein the nipple body portion has a maximum outer diameter of 30 mm or more, and wherein the nipple portion is composed of an elastic material having a hardness of 5 to 25 degrees, and wherein the nipple portion has a thickness in the direction of the center thereof, at the maximum outer diameter portion of the nipple portion, of 1.5 mm or more.

a fixing portion for fixing the artificial nipple at the container.

According to the construction of claim 4, there is provided a feeding bottle provided with the artificial nipple functioning the effect and so on defined in claim 2.

Preferred Embodiment of the Present Invention

Next, the present invention is described in detail based on the preferred embodiment of the present invention with reference to the attached drawings.

Also, the embodiment as described hereinafter is an example, that is considered to be a best mode by the inventor at filing, and which has several technical limitations to reduce this invention into practice. However, the scope of the present invention, unless noted, may not be construed to be limited into said embodiment.

Figure 1:
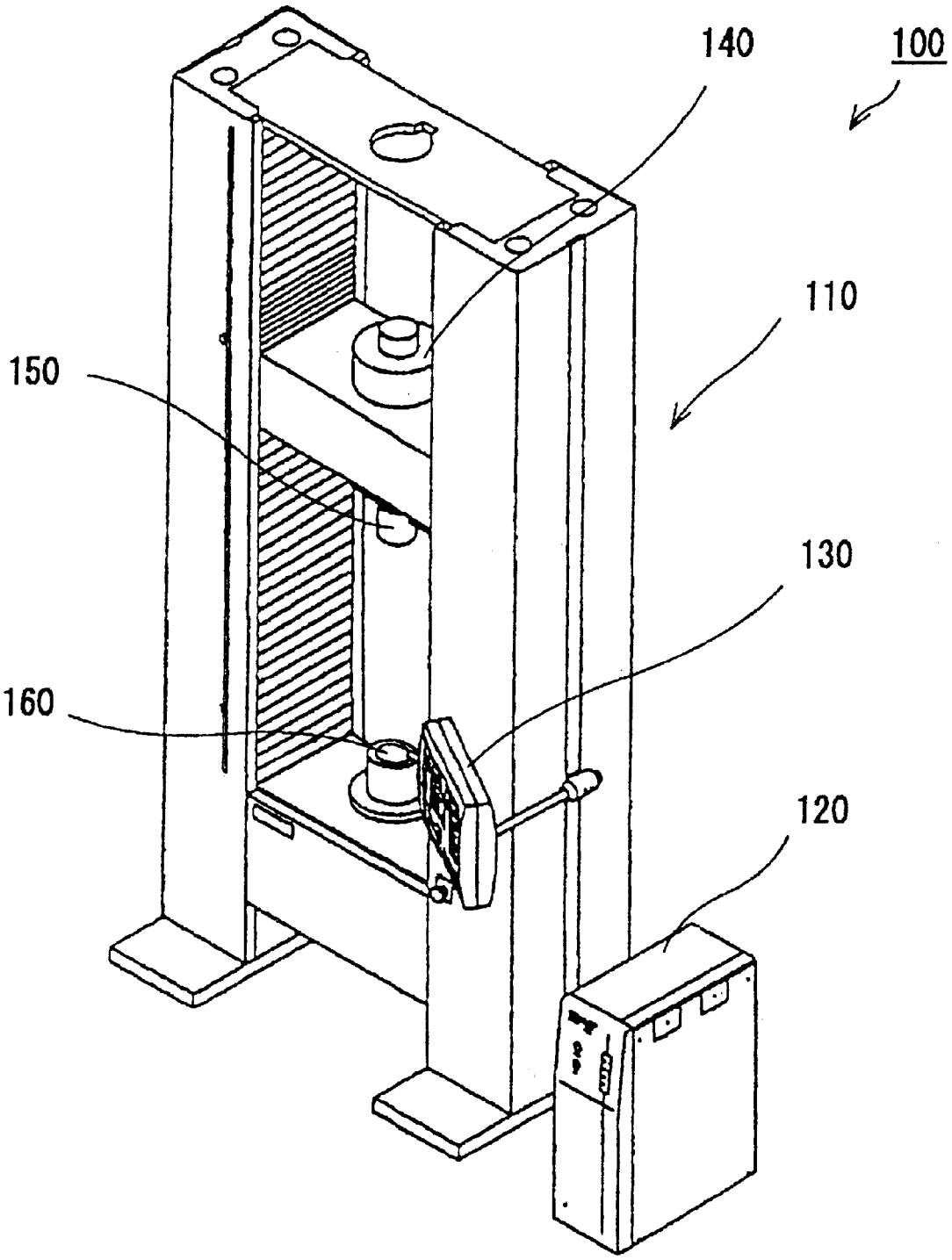
FIG. 1 is a perspective view of the overview showing a precise universal tester as a precise universal testing means, for measuring the stress of nipple elasticity at the maximum outer diameter portion of the nipple portion of the artificial nipple, which is used in measuring the embodiment.

FIG. 1 shows a perspective view of the overview of the precise universal tester 100 of the precise universal testing means for measuring the stress of nipple elasticity at the maximum outer diameter portion of the nipple portion of the artificial nipple, according to the embodiment.

As the precise universal tester 100, Auto-graph AGS-5kNG of Shimadzu Corporation, and so on, may be used.

Also, the precise universal tester 100, as shown in FIG. 1, has a tester body 110, a measuring control device 120, and an operation unit 130. In addition, the tester body 110 is provided with a load cell 140. In the embodiment, SBL-200N, and so on, are used as load cells.

The tester body 110 is also provided with a movable compression jig base 150, capable of being attached to the movable compression jig 170 as described hereinafter, and a fixed compression jig base 160, capable of being attached to the table 200 as described hereinafter.

Figure 2:
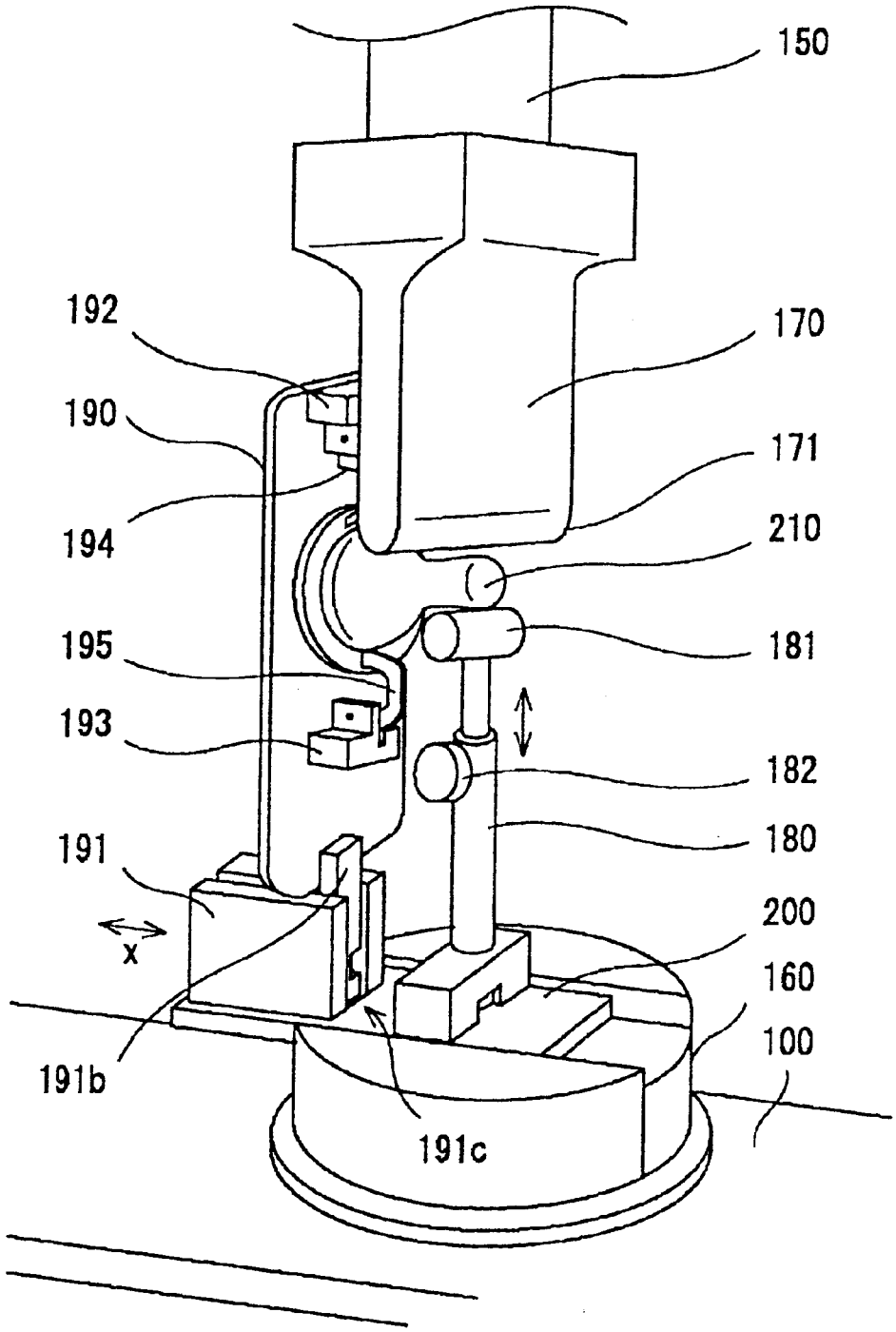
FIG. 2 is a partially magnified perspective view of the overview shown in FIG. 1, particularly showing the condition where a movable compression jig base and a fixed compression jig base are installed on a movable compression jig and a table, respectively.

FIG. 2 shows a partial magnified perspective view of the overview in a condition where the movable compression jig base 150 and the fixed compression jig base 160, as shown in FIG. 1, are attached to the movable compression jig 170 and the table 200, respectively.

In detail, the movable compression jig base 150 as shown in FIG. 1 is attached to the movable compression jig 170 as shown in FIG. 2. The movable compression jig 170 has a movable compression portion 171 at its lower terminal portion, the movable compression portion 171 having a surface with an arc having a radius of 5 mm, approximately.

On the other hand, the fixed compression jig base 160 as shown in FIG. 1 is attached to a table 200 as shown in FIG. 2.

On the table 200, the fixed compression jig 180 as shown in FIG. 2 is arranged in a manner so as to be opposed to the movable compression jig 170.

The fixed compression jig 180 is provided with a cylinder shaped compression part 181 of a compression jig made of metal, the cylinder shaped compression part 181 having a radius of 5 mm, approximately, as shown in FIG. 2.

The cylinder shaped compression part 181 is provided in the fixed compression jig 180 in a manner that the cylinder shaped compression part 181 may change the mutual position therebetween, and thereby, the length between the surface of the movable compression portion 171 of the movable compression jig 170 and the surface of the cylinder shaped compression part 181 may be set in various positions.

In addition, once the cylinder shaped compression part 181 is set up at a predetermined position, a user may adjust and fix it at the position by operating a height adjustment knob 182 provided on the fixed compression jig 180.

Also, there is provided a holding body holder 191 for securing an artificial nipple holding body 190, for holding the artificial nipple 210 that will be measured on the table 200 of the precise universal tester 100.

This holding body holder 191 is provided with a guide groove 191*c* formed thereon, such that a holder side engagement portion 191*b* provided on the artificial nipple holding body 190 may be engaged with the guide groove 191*c*.

The holder side engagement portion 191*b*, as engaged as above, is formed to be provided along the guide groove 191*c* in a movable manner in the directions indicated by the symbol "X" as shown in FIG. 2.

On the artificial nipple holding body 190, the nipple portion 212 of an artificial nipple 210 is fixed between the movable compression jig 170 and the cylinder shaped compression part 181, as shown in FIG. 2.

Figure 3:
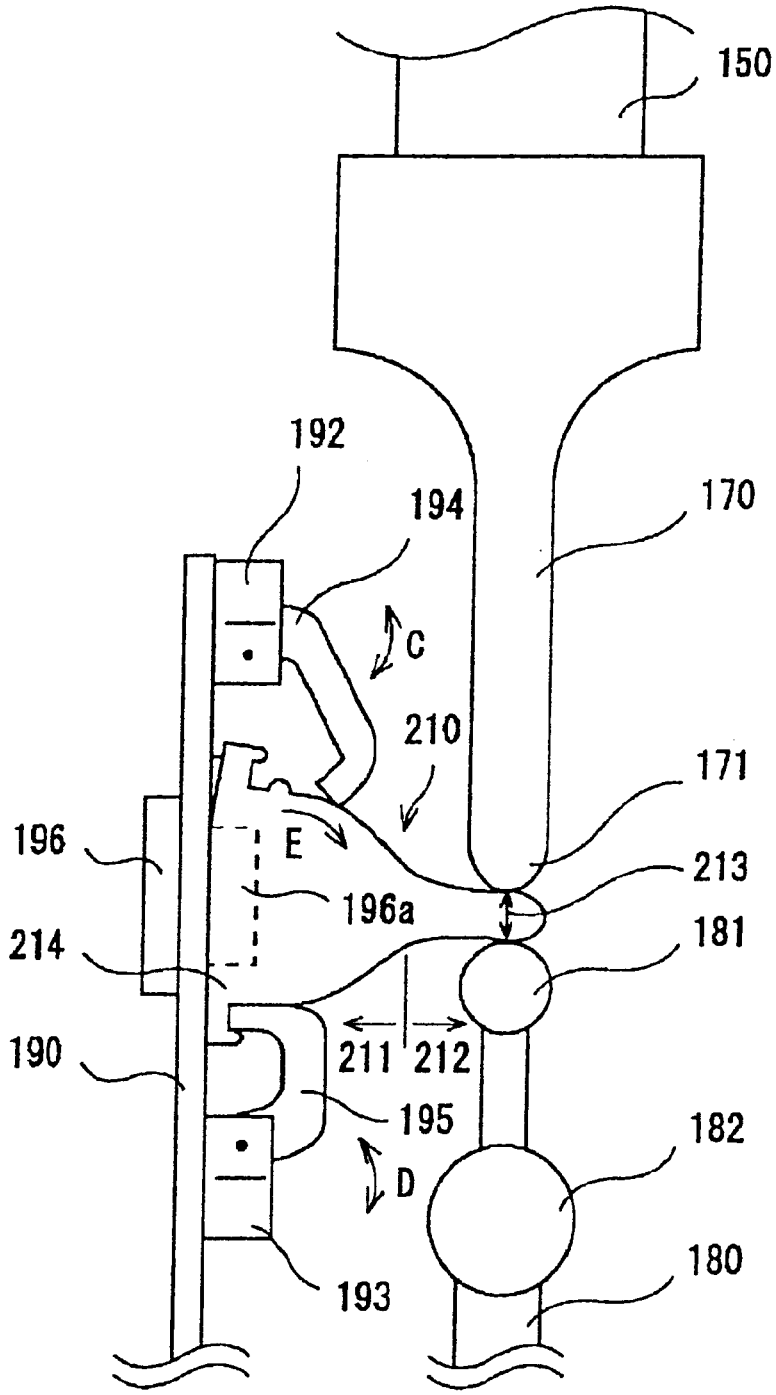
FIG. 3 is a side view of the overview, showing a situation where a maximum outer diameter portion of the nipple portion of the artificial nipple is in contact with both of the movable compression portion of the movable compression jig and the cylindrically shaped compression part, as shown in FIG. 2.

Detail constructions are shown in FIG. 2 and FIG. 3. FIG. 3 shows a side view of the overview in a condition that a nipple portion 212 of the artificial nipple 210 is in contact with the movable compression part 171 of the movable compression jig 170 and the cylinder shaped compression part 181, and then, the movable compression jig 170 is moved to compress the nipple portion 212.

As shown in FIG. 3, the artificial nipple holding body 190 is provided with an artificial nipple arranging part 196 formed thereon. The artificial nipple arranging part 196 has an artificial nipple arranging convex portion 196*a* formed thereon, on which the inner portion of the artificial nipple 210 may be located so as to attain a predetermined position.

Also, the artificial nipple holding body 190 is provided with an upper side holding pin supporter 192 and a lower side pin supporter 193, as shown in FIG. 3. The upper side holding pin supporter 192 has an upper holding pin 194 movable in the directions indicated by the symbol "C" in FIG. 3, and the lower side pin supporter 193 has a lower holding pin 195 movable in the directions indicated by the symbol "D" in FIG. 3.

In detail, the lower holding pin 195 contacts the base portion 214 of the artificial nipple 210 so as to fix one of the terminal portions of the base portion 214, as shown in FIG. 3.

On the other hand, the upper holding pin 194 is located at the other terminal portion of the base portion 214, such that the upper holding pin 194 is located in a manner so as to press against the nipple body portion 211 of the artificial nipple 210, as shown in FIG. 3.

As described above, the upper holding pin 194 is located not on the base portion 214 of the artificial nipple 210 but on the nipple body portion 211 in a manner such that the artificial nipple is loosely fixed.

By the way, the precise universal tester 100 is operated and the movable compression jig 170 goes down to make an elastic transformation, during which the artificial nipple 210 is drawn in the direction indicated by the symbol "E", as shown in FIG. 3. At that time, if the upper holding pin 194 fixes the base portion 214 of the artificial nipple 210 in the same manner as the lower fixed portion of the base portion 214, a force for drawing the artificial nipple 210 in the opposite direction indicated by the symbol "E", may be generated, resulting in impossibility to precisely measure the elasticity of the nipple portion 212. This is because the upper holding pin 194 is not designed to tightly or completely fix the artificial nipple 210.

The precise universal tester 100 is constructed as described above. Next, its operation is explained.

First of all, the table 200, which supports an artificial nipple holding body 190 via the holding body holder, is moved to the left direction in FIG. 2, that is the direction away from the movable compression jig 170.

Then, the artificial nipple 210 is attached to the artificial nipple holding body 190, as shown in FIG. 3. In order to eliminate the effect due to temperature change, the environmental temperature is defined at 23° C.±2° C., and at the environmental temperature, the artificial nipple should be kept to leave for at least 1 hour before testing. Then, the table 200 is moved toward the movable compression jig 170.

Then, the holder side engagement portion 191*b*, arranged inside the guide groove 191*c* in the holding body holder 191, is moved to locate the maximum outer diameter portion 213 between the movable compression part 171 and the cylindrical compression part 181. Here, the maximum outer diameter portion 213 is a portion having the longest diameter of the nipple portion of the artificial nipple.

At this point, the height adjustment jig 182 as shown in FIG. 2 is operated to locate the cylinder shaped compression part 181 at a position contacting the lower surface of the maximum outer diameter portion 213 of the nipple portion 210.

Thereafter, the precise universal tester 100 is operated such that the movable compression jig 170 descends until the movable compression part 171 contacts the artificial nipple 210. Then, the maximum outer diameter portion 213 of the nipple portion 212 is compressed under a predetermined force so as to measure the nipple elasticity of the artificial nipple 210.

In detail, the movable compression part 171 and the cylinder shaped compression part 181 are positioned to contact the nipple portion 212 of the artificial nipple 210 as described above, such that the "zero point correction" may be established.

Next, the movable compression jig 170 is moved at a speed of 100 mm per minute, to continuously deform the maximum outer diameter portion 213 of the nipple portion 212 by 20%, 30%, 40%, 50%, and 60%, during which the stress is measured in unit of Newton (N).

Then, the artificial nipple 210 to be tested by the precise universal tester 100 will be explained.

Figure 4:
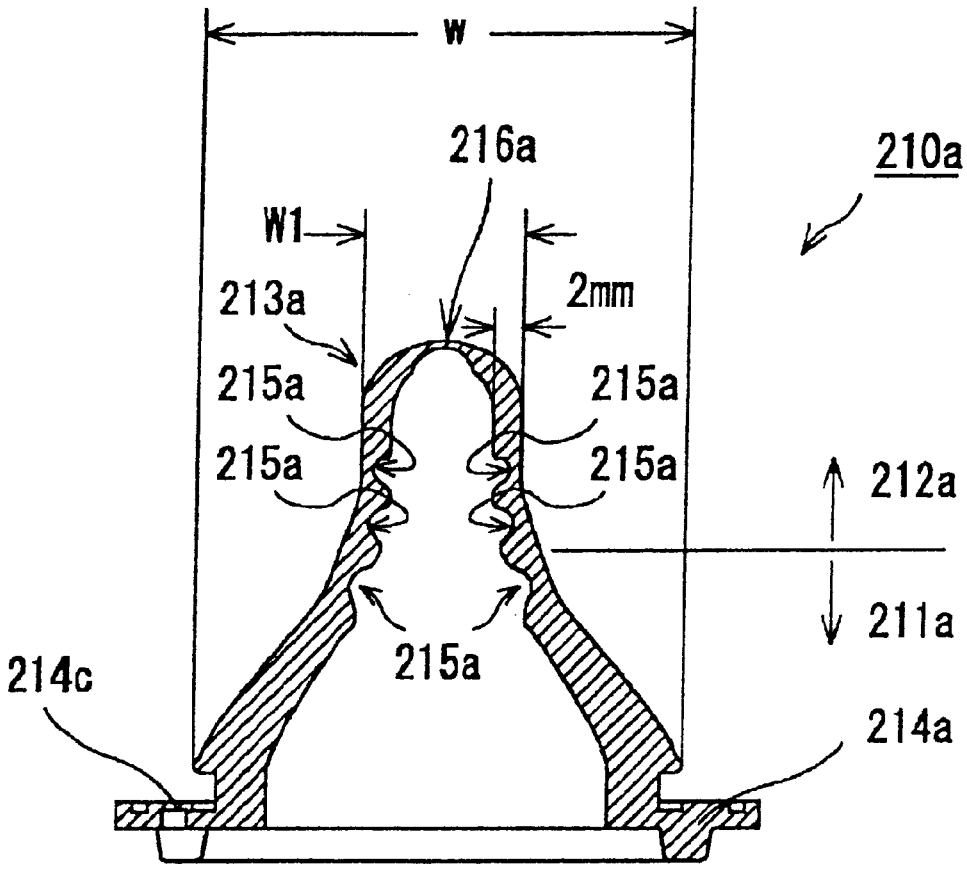
FIG. 4 is a cross-sectional view of the overview of the first artificial nipple.
Figure 5:
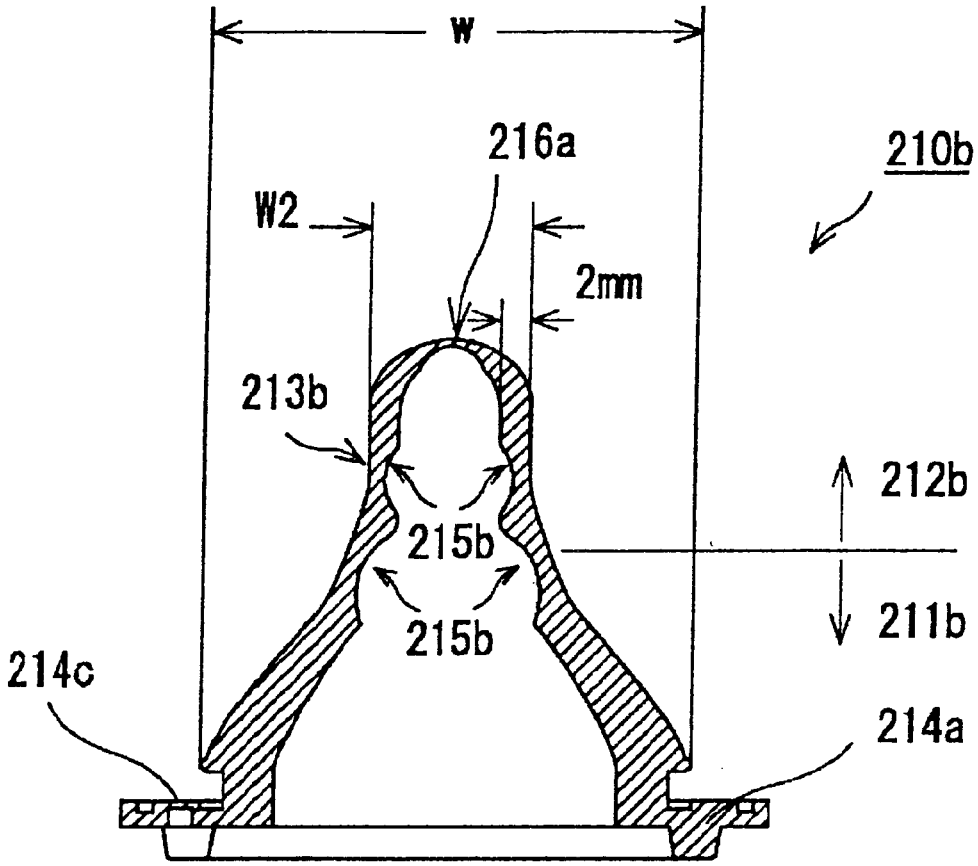
FIG. 5 is a perspective view of the overview of the second artificial nipple.
Figure 6:
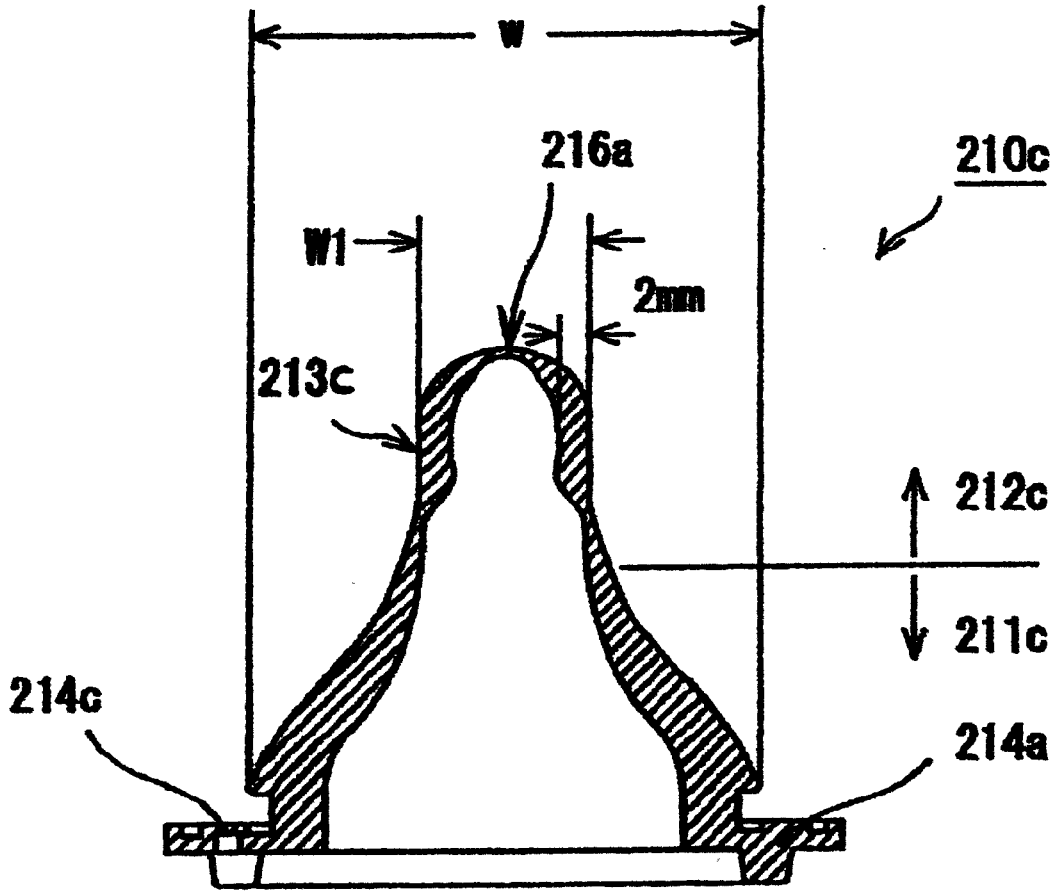
FIG. 6 is a perspective view of the overview of the third artificial nipple.

There are three kinds of examples of artificial nipple 210 described in this specification: the first artificial nipple 210*a* shown in FIG. 4, the second artificial nipple 210*b* shown in FIG. 5, and the third artificial nipple 210*c* shown in FIG. 6. In addition, there is another example of the fourth artificial nipple, which is not shown in the figures.

The First Artificial Nipple 210*a*

FIG. 4 shows a cross-sectional view of the overview of the first artificial nipple 210*a*.

As shown in FIG. 4, the first artificial nipple 210*a* comprises a nipple portion 212*a* formed by a first curved surface, whose tip is provided with an opening portion 216*a*; a nipple body portion 211*a* formed on the nipple portion 212*a*, having a second curved surface. The second curved surface of the nipple body portion 211*a* is continuously extended outward from the first curved surface of the nipple portion 212*a*. The second curved surface of the nipple body portion 211*a* is significantly expanded outward as the part of the second curved portion goes away from the nipple portion 212*a*.

Also, the first artificial nipple 210*a* comprises a base portion 214*a* connected to the nipple body portion 211*a*, in which the base portion 214*a* is capable of being attached to a container such as a feeding bottle to house liquid such as formula.

Also, the base portion 214*a* is provided with a ventilation valve 214*c* formed thereon. The ventilation valve 214*c* is made of a thin portion formed on the base portion 214*a* accompanied with a slit provided on the thin portion. Also, the thin portion may be sloped.

The ventilation valve 214*c* is usually closed, but the valve may be opened in order to adjust the imbalance of the pressure when there occurs an imbalance of the pressure.

The nipple portion 212*a* is provided with a maximum outer diameter portion 213*a*, that is, a portion having the longest outer diameter, and the width (w1) of the maximum outer diameter portion is 13.0 mm. Also, the thickness at the maximum outer diameter portion 213*a* is 2.0 mm.

The outer diameter portion is designed to be thicker than that of conventional products. This is because silicone rubber of a comparatively soft type, as described hereinafter, is selected to be used in the first artificial nipple, resulting in that the nipple portion 212*a*, and the like, of the first artificial nipple 210*a* as shown in FIG. 4 may be deformed inside and be crushed. To avoid such deformation, the outer diameter portion is designed to be thicker than conventional products.

The first artificial nipple 210*a* is made of, for example, silicone rubber, which may have a hardness of 15±5 degrees. The hardness may be range between 5 degrees and 25 degrees, and preferably between 10 degrees and 25 degrees.

The hardness is measured by a durometer type A in accordance with JIS-K6253 (ISO7619). The silicone rubber used in the present invention is significantly softer than that of conventional products, since the silicone rubber used for the conventional artificial nipple has a hardness of about 40 degrees.

When the silicone rubber as mentioned above has a hardness of less than 5 degrees, it is too soft for an infant, and so on, to use the first artificial nipple 210*a* and to easily move his or her tongue in the peristaltic manner as described above. In addition, it may be dangerous for an infant, and so on, to get accustomed to an improper peristaltic manner of movement, which may result in stunted growth.

Also, if the first artificial nipple 210*a*, made of a silicone rubber having a hardness of less than 5 degrees, is attached to, for example, a feeding bottle, the inside of the first artificial nipple 210*a* may be deformed due to a negative pressure generated by the reduction of the contents housed in the feeding bottle.

Further, silicone rubber having a hardness of less than 5 degrees may create a risk that the artificial nipple 210*a* will detach from the feeding bottle due to deformation of the artificial nipple, when an infant, and the like, moves his or her tongue in a peristaltic manner so as to draw the first artificial nipple 210*a* into the deep inner portion of the mouth, during the process of the "second elongation."

Therefore, silicone rubber having a hardness of less than 5 degrees is inappropriate for use in the first artificial nipple 210*a*.

On the other hand, if silicone rubber having a hardness of more than 25 degrees is used, it is too hard to be used as an artificial nipple, so that such artificial nipple may not be elongated. In addition, such an artificial nipple may discourage an infant, and so on, from moving his or her tongue in a peristaltic manner. In other words, inasmuch as the peristaltic manner of movement is carried out while the mouth transforms or elongates the artificial nipple, but a silicone rubber having a hardness of more than 25 degrees is too hard to transform or elongate the artificial nipple.

Therefore, a silicone rubber having a hardness of more than 25 degree is inappropriate for use in the first artificial nipple 210*a*.

Also, the opening 216*a* as mentioned above is formed as a slit having a shape, such as, a circled hole, a cross, a "Y" character, a straight line, and the like.

In addition, there is formed grooved portions 215*a*, having a thickness thinner than that of the other portions, at the inside of the nipple portion 212*a* and nipple body portion 211*a*. In the case of the first artificial nipple 211*a*, there are three groove portions 215*a* designed to be arranged in a circle.

The grooved portion 215*a* is formed in a manner to be gradually becoming thicker from the deepest or thinnest portion while the border between the grooved portion 215*a* and the inside of the first artificial nipple 210*a* is made smooth to be formed into a wave shape as shown in FIG. 4.

Thus, the nipple body portion 211*a* of the first artificial nipple 210*a*, as shown in FIG. 4, has the maximum outer diameter w of 38.6 mm.

The Second Artificial Nipple 210*b*, the Third Artificial Nipple 210*c*, and the Fourth Artificial Nipple FIG. 5 and FIG. 6 show the overviews of the second artificial nipple 210*b* and the third artificial nipple 210*c*, respectively.

Regarding the second artificial nipple 210*b* and the third artificial nipple 210*c*, there are several portions, which are common to those of the first artificial nipple 210*a* as shown in FIG. 4. Those portions of the second artificial nipple 210*b* and the third artificial nipple 210*c* are symbolized by the same symbols of the first artificial nipple in order to abbreviate repeated parts of the explanation therefor. Therefore, the following explanation mainly relates to the portions different from those of the first artificial nipple 210*a*.

Unlike the first artificial nipple 210*a* as shown in FIG. 4, the second artificial nipple 215*b* as shown in FIG. 5 is provided with two grooved portions 215*b*, with each of the grooved portion being ring shaped.

Unlike the first artificial nipple 210*a* or the second artificial nipple 210*b* as stated above, the third artificial nipple 210*c* as shown in FIG. 6 is not provided with grooved portions, but is provided with a gradually thinned portion formed between the nipple body portion 211*c* and the nipple portion 212*c*.

The nipple portions 212*b*, 212*c* of the second artificial nipple 210*b* and the third artificial nipple 210*c*, respectively, have maximum outer diameter portions 213*b*, 213*c* having a maximum diameter, respectively. Each of the widths (w1) of the maximum outer diameter portions is 13.0 mm, which is the same as that of the first artificial nipple 210*a*. Also, each of the thickness of both maximum outer diameter portions 213*b*, 213*c* is 2.0 mm, which is the same as that of the first artificial nipple 210*a*.

The fourth artificial nipple has a similar construction of the second artificial nipple 210*b*, with the exception that the maximum outer diameter portion 213*b* of the nipple portion 212*b* has a thickness of 1.6 mm, and that the silicone rubber has the hardness of 20±2 degrees.

It is of note that, the nipple elasticity of those artificial nipples: the first artificial nipple 210*a*, second artificial nipple 210*b*, third artificial nipple 210*c*, and fourth artificial nipple, as described above, are measured by the precise universal tester 100 as shown in FIG. 1.

In detail, the precise universal tester 100 is operated such that the movable compression jig 170 descends at a speed of 100 mm per minute to continuously deform the maximum outer diameter of the nipple portion of the artificial nipple by 20%, 30%, 40%, 50% and 60% so as to measure stress in unit of N (Newton) under each load.

Here, the reason why the maximum outer diameter portion of the artificial nipple is deformed or compressed by 20% is to simulate the condition of "transformation" when an infant, and the like, contacts the tip of the nipple portion at the deepest point of his or her mouth roof cavity by the tongue at the stage of the "step to prepare sucking", as shown in FIG. 15. Such deformation or compression is also to simulate a condition of the initial feelings which are given to the infant when holding a nipple in his or her mouth at a weak force and in a peristaltic manner movement.

Also, the reason why the maximum outer diameter portion of the artificial nipple is deformed or compressed by 60% is for simulating a later condition under a comparatively strong force given when an infant, and the like, elongates or transforms the nipple portion with the peristaltic manner movement at the stage of the "second elongation".

Also, it is also reasoning that the inside, or the inner diameter portion, of the maximum outer diameter portion of the nipple portion may be hit together by more than 60%.

To deform or compress the artificial nipple by 30%, 40% and 50% is for measuring the property thereof.

FIG. 7 is a table showing the conditions, results and so on measured by the precise universal tester 100 as shown in FIG. 1.

Next, the examples 1 to 4 according to the present invention and the comparative examples 1 to 6 as shown in FIG. 7 are explained below.

EXAMPLE 1

The first artificial nipple 210*a* as shown in FIG. 4 is used as the artificial nipple of example 1.

EXAMPLE 2

The second artificial nipple 210*b* as shown in FIG. 5 is used as the artificial nipple of example 2.

EXAMPLE 3

The third artificial nipple 210*c* as shown in FIG. 6 is used as the artificial nipple of example 3.

EXAMPLE 4

The fourth artificial nipple is the one described above as the fourth artificial nipple.

Comparative Example 1

Following artificial nipple is used as comparative example 1.

Seller (Producer): Pigeon Corporation

Code or product name: Nipple type B 361 for mother's milk consulting rooms (made in Japan)

Material and the like of the artificial nipple: made of silicone rubber having a hardness of 35 degrees, and having a maximum outer diameter (w) of 38.0 mm, a maximum outer diameter portion (w1) of the nipple portion of 12.5 mm, and a thickness at the maximum outer diameter portion of 1.0 mm Comparative Example 2

The following artificial nipple is used as comparative example 2.

Seller (Producer): Aprica (Handi-Craft) Corporation

Code or product name: Nipple type 42004 made specially for Dr. Brown's Feeding Bottle (made in Germany)

Material and the like of the artificial nipple: made of silicone rubber having a hardness of 43 degrees, and having a maximum outer diameter (w) of 37.5 mm, a maximum outer diameter portion (w1) of the nipple portion of 14.0 mm, and a thickness at the maximum outer diameter portion of 1.3 mm Comparative Example 3

The following artificial nipple is used as comparative example 3.

Seller (Producer): Tristar International Co., Ltd. (Evenflo corporation)

Code or product name: Elite Nipple type 2115611J (1171) (made in the United State of America)

Material and the like of the artificial nipple: made of silicone rubber having a hardness of 45 degrees, and having a maximum outer diameter (w) of 50.0 mm, a maximum outer diameter portion (w1) of the nipple portion of 13.5 mm, and a thickness at the maximum outer diameter portion of 1.5 mm Comparative Example 4

The following artificial nipple is used as comparative example 4.

Seller (Producer): Toys R Us Corporation (Luvn' Care Corporation)

Code or product name: Nipple type 1314LA (2000100) for nursing system feeding bottles (made in the China)

Material and the like of the artificial nipple: made of silicone rubber having a hardness of 47 degree, and having a maximum outer diameter (w) of 38.0 mm, a maximum outer diameter portion (w1) of the nipple portion of 13.3 mm, and a thickness at the maximum outer diameter portion of 1.7 mm Comparative Example 5 he following artificial nipple is used as comparative example 5.

Seller (Producer): Chuchu Baby Corporation (Jex Corporation)

Code or product name: Nipple of soft type YT1050 (OA0405)

Material and the like of the artificial nipple: made of silicone rubber having a hardness of 33 degrees, and having a maximum outer diameter (w) of 27.8 mm, a maximum outer diameter portion (w1) of the nipple portion of 14.0 mm, and a thickness at the maximum outer diameter portion of 1.7 mm Comparative Example 6

The following artificial nipple is used as comparative example 6.

Seller (Producer): Pigeon Corporation

Code or product name: Nipple of deluxe type S B050 (made in Thailand)

Material and the like of the artificial nipple: made of silicone rubber having a hardness of 35 degrees, and having a maximum outer diameter (w) of 27.5 mm, a maximum outer diameter portion (w1) of the nipple portion of 13.0 mm, and a thickness at the maximum outer diameter portion of 1.3 mm It is noted that the hardness of the products used as comparative examples is obtained by measurement by means of an A-type durometer in accordance with JIS-K6253 (ISO7619) with respect to a specific part of the base portion. Also, the countries made in are from the descriptions of the packages.

Figure 8:
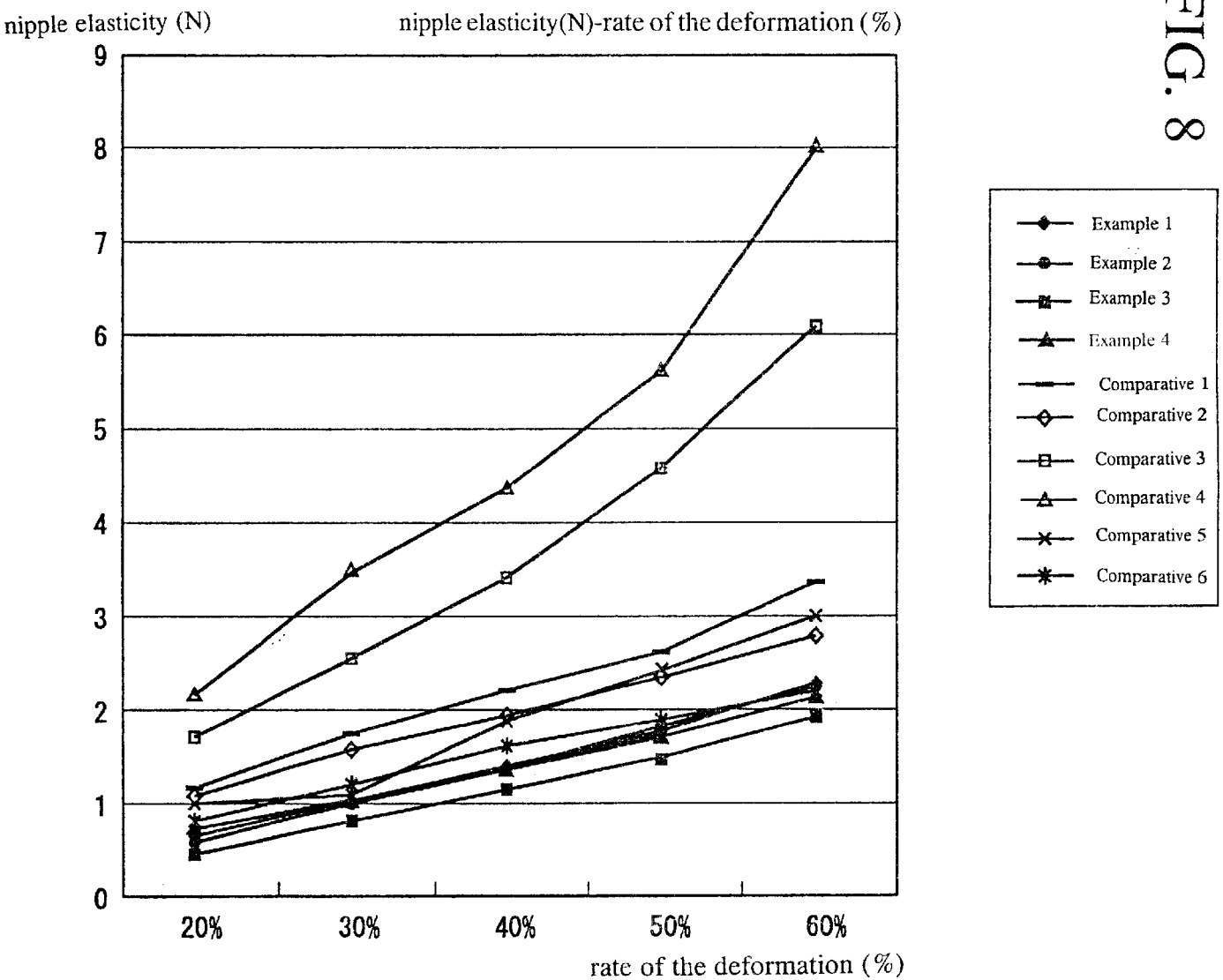
FIG. 8 is a graph of nipple elasticity in the unit of N (Newton) where the artificial nipples of the examples 1 to 4 and the comparative examples 1 to 6 have been placed on the precise universal tester as shown in FIG. 1, followed by operating to go down the movable compression jig to deform the maximum outer diameter portion of the nipple portion of each of the artificial nipples by 20%, 30%, 40%, 50% and 60%.

FIG. 8 shows a graph of the nipple elasticity of the stress in the unit of N (Newton) where the artificial nipples of the examples 1 to 4 and the comparative examples 1 to 6 were placed on the precise universal tester 100 as shown in FIG. 1, followed by descending the movable compression jig 170 to deform each of the maximum outer diameter portions of the nipple portions of the artificial nipples continuously by 20%, 30%, 40%, 50% and 60%.

Figure 9:
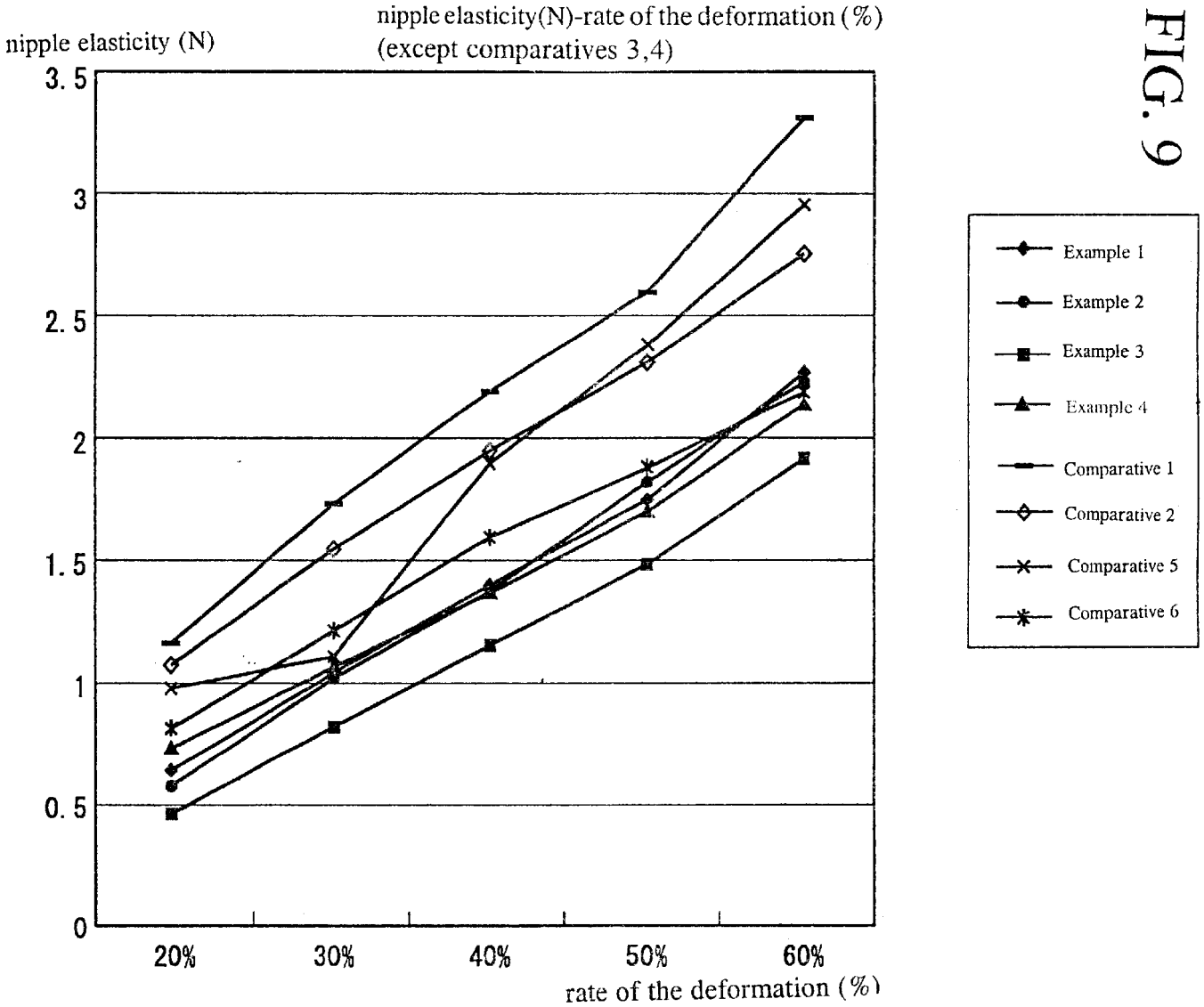
FIG. 9 is a graph shown after correction to shorten the value of the Y axis in the unit of N, by deleting data of the comparative examples 3 and 4 of FIG. 8.

FIG. 9 shows a graph set up to lower the range of the value of the Y axis in the unit of N by deleting data of the comparative examples 3 and 4 of FIG. 8.

As shown in FIG. 9, the artificial nipples of examples 1 to 4, corresponding to the first artificial nipple 210*a*, the second artificial nipple 210*b*, the third artificial nipple 210*c*, and the fourth artificial nipple, have a nipple elasticity ranging between 0.1 N and 0.8 N, when the maximum outer diameter portions 213*a*, 213*b*, 213*c* of the respective nipple portions 212*a*, 212*b*, 212*c* are deformed by 20%.

In the case that an infant, and the like, extends a nipple 32 to his or her mouth roof cavity 22 during the above-mentioned stage of the "step to prepare sucking" as shown in FIG. 15, or at the stage of the "step to start sucking" when implementing a peristaltic manner movement, it is necessary for the nipple to be easily transformable to act in accordance with the movement of the organization in the mouth including the tongue 23.

In this respect, the artificial nipples as examples 1 to 4, corresponding to the first artificial nipple 210*a*, the second artificial nipple 210*b*, the third artificial nipple 210*c*, and the fourth artificial nipple, are easily transformable such that the deepest point of the mouth roof cavity 22 will be contacted by an infant 20, so as to make it possible that an infant moves his or her tongue in a peristaltic manner.

Figure 16:
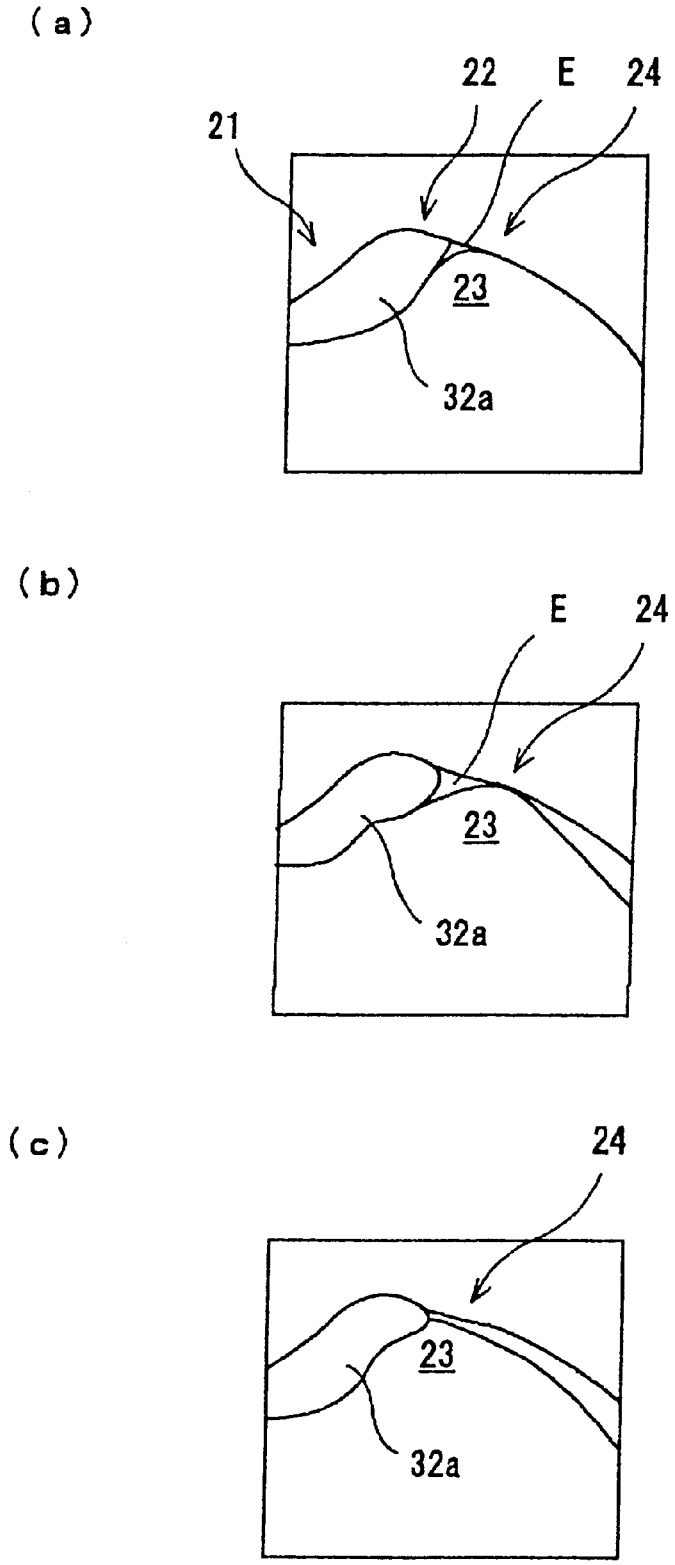
FIG. 16 is a magnified view for explaining the overview in a condition to move a tongue in a peristaltic manner, in relation between the tongue and the tip of the nipple as shown in FIG. 15.

Thus, smooth movement of the tongue in a peristaltic manner is made possible as shown in FIGS. 15 and 16, by allowing the artificial nipple to make contact with the deepest point of his or her own mouth roof cavity, so as to allow the "second elongation" as stated above, and therefore, the artificial nipple according to the present invention is useful for an infant, and the like.

On the other hand, the artificial nipples as comparative examples 1 to 6 have a nipple elasticity of more than 0.8 N (Newton), when the maximum outer diameter portion is deformed by 20%, and therefore, they are difficult for an infant 20 as shown in FIG. 15 to be transformed to contact them at the deepest point of his or her own mouth roof cavity 22. They are also difficult to move the tongue in a peristaltic manner. Thus, such artificial nipples are difficult for an infant, and the like, to use.

By the way, the artificial nipples as examples 1 to 4, corresponding to the first artificial nipple 210*a*, the second artificial nipple 210*b*, the third artificial nipple 210*c*, and the fourth artificial nipple, respectively, have a nipple elasticity ranging between 1.0 N (Newton) and 2.5 N (Newton), when, for example, the maximum outer diameter portions 213*a*, 213*b*, 213*c* of the respective nipple portions 212*a*, 212*b*, 212*c*, and the like, are deformed by 60%, as shown in FIG. 9.

Provided that the artificial nipple has a nipple elasticity of the above range when the maximum outer diameter portion of the nipple portion of the artificial nipple is deformed by 60%, it is easy for an infant 20 to move his or her tongue 23 in a peristaltic manner at the stage of the "second elongation" as shown in, for example, FIG. 16. In addition, the nipple portion may be deformed in the same manner as the nipple 32 as shown in FIG. 16. Furthermore, the nipple portion of the artificial nipple may be deformed to the extent not to inferiorly spouting out formula, and so on, and therefore, the artificial nipple may prevent formula, and so on, from inferiorly spouting out.

Especially, there is sometimes deformed to the extent to close the flowing path unless the nipple portion has a nipple diameter of less than 1.0 N when the maximum outer diameter portion is deformed by 60%. On the other hand, an artificial nipple, necessary to have a nipple elasticity of more than 2.5, makes it difficult for an infant to move the tongue in a peristaltic manner, and in addition, may continue to be a half ball shape without being transformed in a vertical direction (or the upper and lower direction), and thereby, an infant is interrupted to smoothly move his or her tongue in a peristaltic manner.

As described above, the artificial nipples as examples 1 to 4, corresponding to the first artificial nipple 210*a*, the second artificial nipple 210*b*, the third artificial nipple 210*c*, and the fourth artificial nipple, may be deformed by 60% of the maximum outer diameter portions 213*a*, 213*b*, 213*c*, if a load of force (or energy) of 1.0 N (Newton) to 2.5 N (Newton) is applied at, for example, the maximum outer diameter portions 213*a*, 213*b*, 213*c*, of the nipple portions 212*a*, 212*b*, 212*c*, and the like.

Therefore, the artificial nipple according to the present invention allows an infant to easily move his or her tongue in a peristaltic manner at the stage of "second elongation," and therefore, the artificial nipple according to the present invention is easy to use. Especially, the artificial nipple according to the present invention does not prevent an infant from smoothly moving his or her tongue in a peristaltic manner, since the artificial nipple does not have a nipple elasticity of more than 2.5 N when the maximum outer diameter portion of the nipple portion is deformed by 60%.

FIG. 10 is a table showing varied quantities of nipple elasticity in the unit of N (Newton) when the deformed amount in the FIG. 7 is 20%, 30%, 40%, 50% or 60%.

For example, "30–20%" described in FIG. 10 means the difference between the nipple elasticity (N) deformed by 30% and the nipple elasticity (N) deformed by 20%. Similarly, the difference of the nipple elasticity in case of "40–30%", "50-40%" and "60–50%" are shown.

As shown in FIG. 10, the third artificial nipple 210*c* as example 3 has the "30–20%" being 0.34 N, the "40–30%" being 0.33N, the "50-40%" being 0.35N and the "60–50% " being 0.42 N.

Therefore, the third artificial nipple 210*c* shows a behavior that the less the deformed quantity (%) is, the more the varied quantity (%) is obtained.

Thus, at the beginning of the deforming of the third artificial nipple 210*c*, the artificial nipple is continuously and easily deformed. On the other hand, as the deformed quantity (%) goes over 40%, and in particular, comes to 50% or 60%, a larger force than before is necessary to continue to be deformed.

Accordingly, the third artificial nipple as example 3, compared with the other examples, allows an infant to easily move his or her tongue in a peristaltic manner, and is designed to prevent the flowing path from being closed due to complete deformation of the artificial nipple, and thereby, the artificial nipple avoids inferior spouting out.

By the way, for example, the nipple body portions 211*a*, 211*b*, 211*c* of the artificial nipples as examples 1 to 4, corresponding to the first artificial nipple 210*a*, the 2nd artificial nipple 210*b*, the 3rd artificial nipple 210*c*, and the like, have a maximum outer diameter (w) of 30 mm or more.

Also, the nipple body portion 211*a* has an outer shape formed to be larger as the nipple portion 212*a* goes to the base portion 214*a*.

Therefore, an infant and the like may hold the artificial nipple 210 in his or her mouth while significantly opening his or her lips, in the same manner to hole the nipple of his or her mother and the like. Accordingly, the infant, and the like, may place his or her own tongue 23 in a condition where the tongue 23 goes over his or her lower tooth bank 28*b* and touches the lower lip 27*b*, which is the same condition as the infant, and the like, holds the nipple of his or her mother or someone in the mouth.

Thus, according to the artificial nipple 210, it is easy for an infant to smoothly move his or her tongue 23 in a peristaltic manner, so as to carry out the stage of the "second elongation" as stated before.

Figure 11:
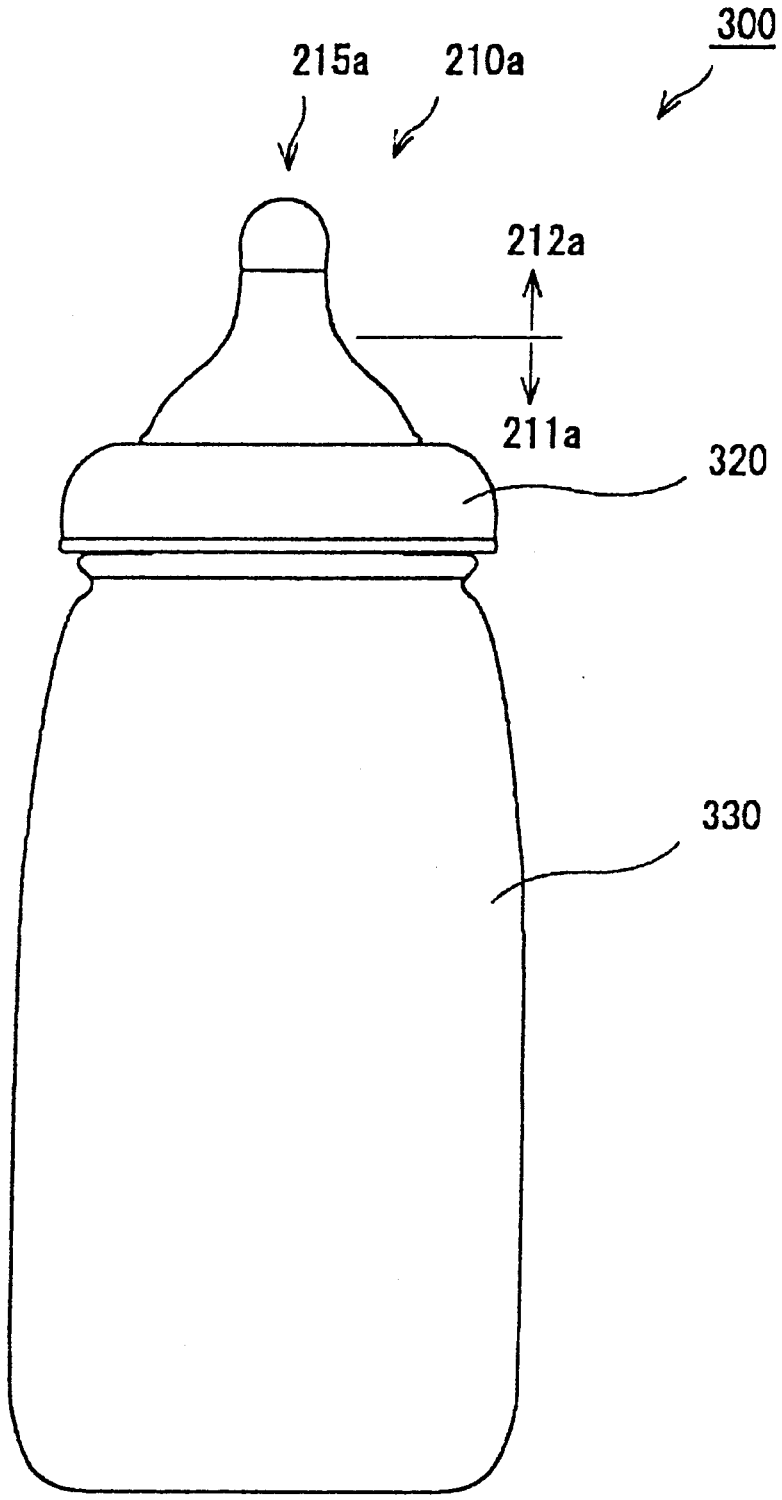
FIG. 11 is a view of the overview showing a feeding bottle with an artificial nipple, in which a feeding bottle is provided with an artificial nipple.

The artificial nipple 210 as described above, corresponding to the first artificial nipple 210*a*, 2nd artificial nipple 210*b*, 3rd artificial nipple 210*c*, and 4th artificial nipple, is installed on a feeding bottle 330 made of glass capable of housing liquid, such as formula, and so on, via a cap 320 made of a resin, as shown in FIG. 10. FIG. 11 is a view showing the overview of an artificial nipple having a feeding bottle 300, in which a feeding bottle is provided with an artificial nipple.

Next, such a fixing means is explained based on the first artificial nipple 210*a*. Also, the second artificial nipple 210*b* or third artificial nipple 210*c* may be used.

Figure 12:
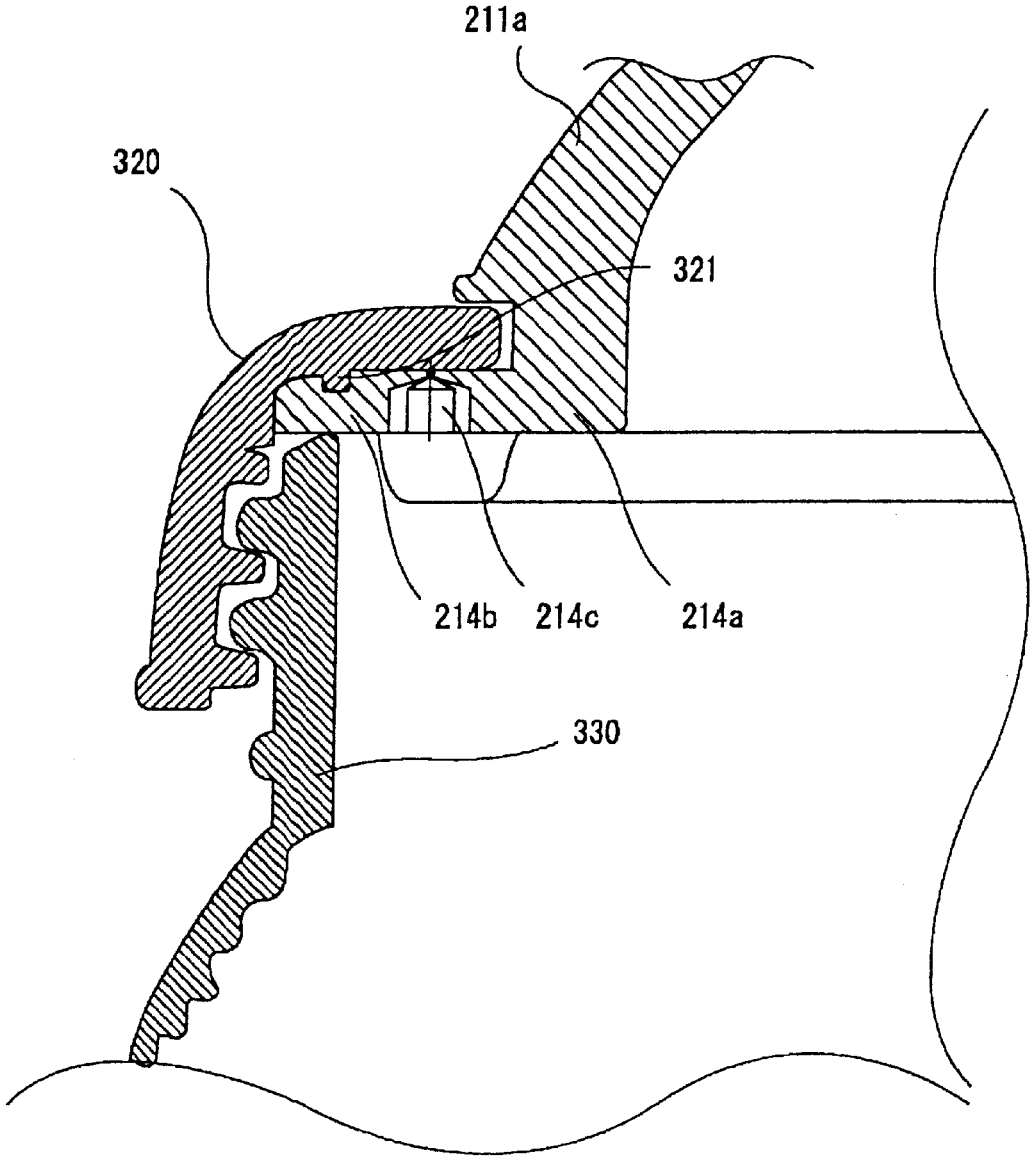
FIG. 12 is a cross-sectional view of the overview, showing a relationship among a first artificial nipple, cap and feeding bottle.

FIG. 12 is a cross-sectional view of the overview showing the relationship between the cap 320 and the feeding bottle 330.

As shown in FIG. 12, the base portion 214*a* is continuously formed or extended from the nipple body portion 211*a* of the first artificial nipple 210*a*.

In addition, a cap 220 is attached on the base portion 214*a*, covering it. The interior of the cap 320 is fixed on the exterior of the feeding bottle 330 by screw engagement.

In other words, the cap 320, covering the base portion 214*a* of the first artificial nipple 210*a*, is screw engaged with the feeding bottle 330, and thereby, the first artificial nipple 210*a* is fixed on the feeding bottle 330.

Here, the base portion 214*a* is provided with a ventilation valve 214*c*, a valve of a slit formed in a thin portion thereof, such that the ventilation valve 214*c* opens when the housed formula, and the like, are reduced to generate a negative pressure in the feeding bottle 330, so as to cancel the negative pressure generated inside the feeding bottle.

Also, the cap as a preferred embodiment is provided with a cap convex portion 321, that is a convex portion as attaching means, at the inside portion of the cap 320 contacting the base portion 214*a* of the cap 320.

On the other hand, the surface of the base portion 214*a*, to which the cap 320 is opposed, has a base portion concave portion 214*b*, corresponding to the cap convex portion 321.

Accordingly, the base portion concave portion 214*b* is engaged with the cap convex portion 321 so as to enhance a sealing property between the first artificial nipple and the cap 320. Therefore, the first artificial nipple 210*a* is prevented from accidentally detaching from the cap 320 due to insufficiency of fixation.

In addition, the cap 320 may also increase the adhesion property between the base portion 214*a* and the feeding bottle 330, and thereby, the formula and the like housed in the feeding bottle 330 is prevented from leaking out.

Also, the preferred embodiment as described above has a convex at the cap 320 and a concave at the base portion 214*a*. Instead of such constructions, a concave may be formed on the cap 320 and a convex may be formed on the base portion 214*a* for engaging the concave with the convex.

In other words, the base portion 214*a* may be provided with a base portion convex portion or base portion concave portion formed thereon, and the cap 320 as attaching means may have a concave portion or a convex portion as attaching means, corresponding to the above.

Figure 13:
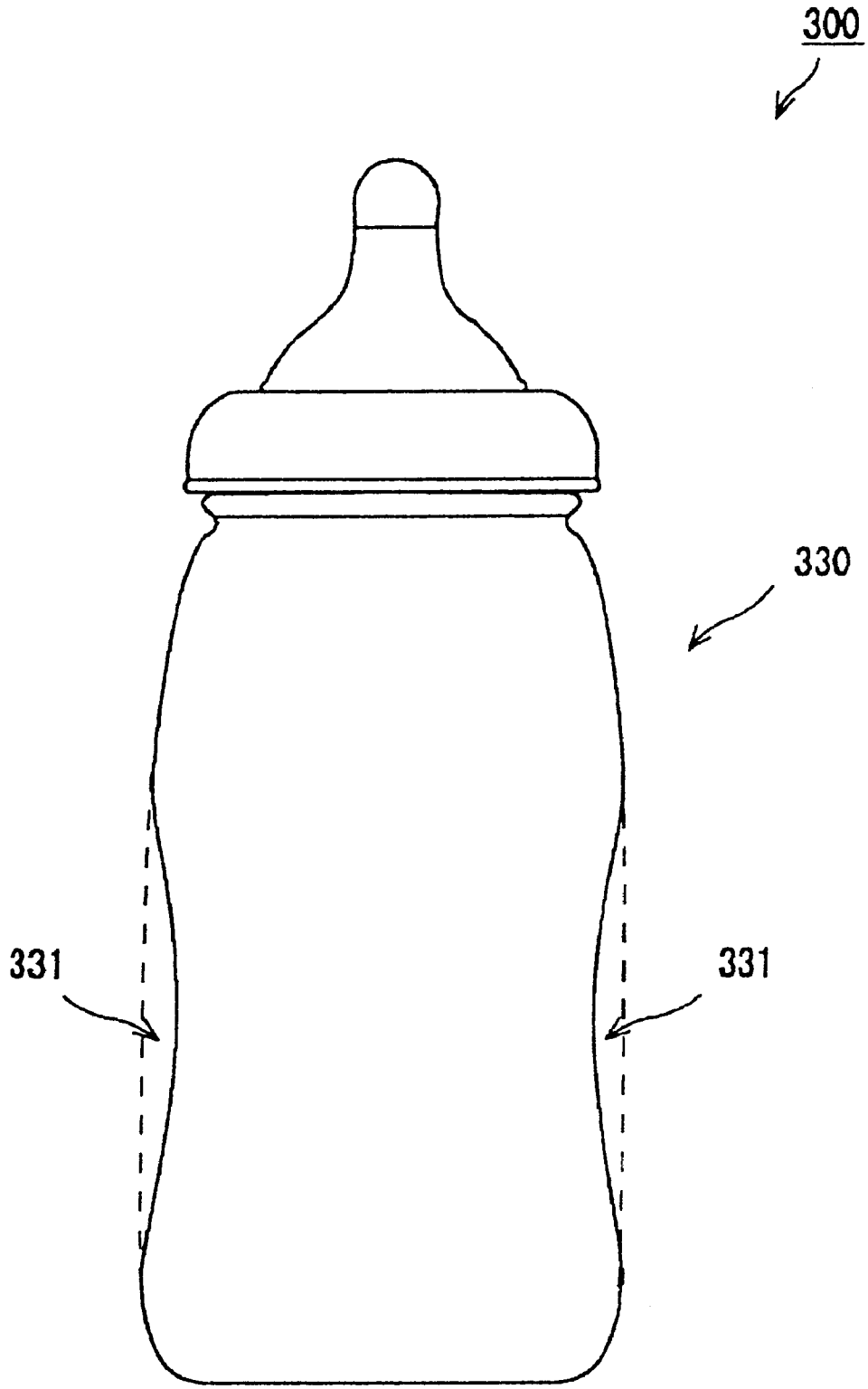
FIG. 13 is a cross-sectional view of the overview, showing the side view of FIG. 10.
Figure 14:
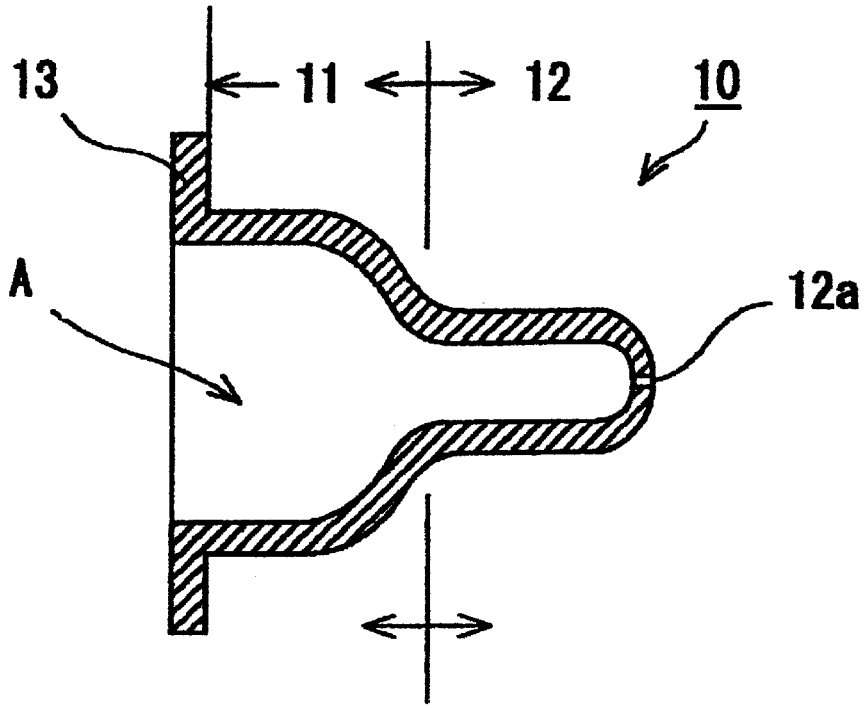
FIG. 14 CONVENTIONAL ART
FIG. 14 is a cross-sectional view of the overview, showing a conventional artificial nipple.

By the way, FIG. 13 is a side view showing the overview shown in FIG. 11. As shown in FIG. 13, the outer surface of the feeding bottle 330 has several curved portions 331 approximately at the center thereof, the curved portions extending in the vertical direction. For example, there are formed two curved portions 331.

Thus, the two curved portions 331 are formed at the side surface of the feeding bottle 330 in a manner to oppose each other. Therefore, a user, for example, an infant, may place his or her fingers on the curved portions to easily hold the feeding bottle 330.

Observation of the appearance or by echo pictures, on the occasion when the first artificial nipple 210*a*, second artificial nipple 210*b* and third artificial nipple 210*c* were actually used by an infant to be nursed with a feeding bottle 300, showed that the infant moves his or her mouth in the same manner to be nursed with a nipple of his or her mother, and the like. In particular, observation by echo pictures showed that the infant smoothly moved his or her mouth in a peristaltic manner, and the flowing path was not closed.

Moreover, the person ordinary skilled in the art may modify the preferred embodiments as mentioned above into others having some constructions omitted or added, or having a combination thereof.

As described above, according to the present invention, the artificial nipple may be elongated or transformed appropriately so that an infant will move his or her tongue in a peristaltic manner, in the same way as when breast-feeding. Also, the present invention may prevent any drink from inferior spouting out due to closing the flowing path.

What is claimed is:

1. An artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to house a drink, wherein the nipple body portion has a maximum outer diameter of 30 mm or more, and wherein the nipple portion is composed of an elastic material having a nipple elasticity of 0.1 N to 0.8 N at the time when the maximum outer diameter of the nipple portion is compressed by 20%, and of 1.0N to 2.5N at the time when the maximum outer diameter of the nipple portion is compressed by 60%, wherein the nipple portion is measured by placing the base portion of the artificial nipple on a precise universal tester having a metallic pressing top made of a cylindrical shape with a radius of about 5 mm, to compress the maximum outer diameter of the nipple portion into the direction of the center thereof.

2. The artificial nipple of claim 1, wherein the nipple portion has a thickness in the direction of the center thereof, at the maximum outer diameter portion of the nipple portion, that is greater than or equal to 1.5 mm.

3. The artificial nipple of claim 1, wherein the artificial nipple is made from silicone rubber.

4. The artificial nipple of claim 1, wherein the artificial nipple includes at least one groove located on an inner surface of the nipple portion.

5. The artificial nipple of claim 1, wherein the artificial nipple includes a plurality of grooves located on an inner surface of the nipple portion, the grooves being formed about a longitudinal axis of the nipple portion.

6. An artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to house a drink, wherein the nipple body portion has a maximum outer diameter of 30 mm or more, and wherein the nipple portion is composed of an elastic material having a Durometer A hardness of 5 to 25, and wherein the nipple portion has a thickness in the direction of the center thereof, at the maximum outer diameter portion of the nipple portion, of 1.5 mm or more.

7. The artificial nipple of claim 6, wherein the artificial nipple is made from silicone rubber.

8. The artificial nipple of claim 6, wherein the artificial nipple includes at least one groove located on an inner surface of the nipple portion.

9. The artificial nipple of claim 6, wherein the artificial nipple includes a plurality of grooves located on an inner surface of the nipple portion, the grooves being formed about a longitudinal axis of the nipple portion.

10. A feeding bottle comprising:

a container to house a drink;

an artificial nipple attached to the container; the artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is attached to the container to house a drink, wherein the nipple body portion has a maximum outer diameter of 30 mm or more, wherein the nipple portion is composed of an elastic material having an elasticity of 0.1 N to 0.8 N at the time when the maximum outer diameter of the nipple portion is compressed by 20%, and of 1.0N to 2.5N at the time when the maximum outer diameter of the nipple portion is compressed by 60%, wherein the nipple portion is measured by placing the base portion of the artificial nipple on a precise universal tester having a metallic pressing top made of a cylindrical shape with a radius of about 5 mm, to compress the maximum outer diameter of the nipple portion into the direction of the center thereof; and a fixing portion for fixing the artificial nipple at the container.

11. A feeding bottle comprising:

a container to house a drink;

an artificial nipple attached to the container; the artificial nipple comprising:

a nipple portion having a first curved surface, whose tip is provided with an opening portion;

a nipple body portion formed on the nipple portion, having a second curved surface, wherein the second curved surface of the nipple body portion is continuously extended from the first curved surface of the nipple portion, and wherein the second curved surface of the nipple body portion is significantly expanded as a part of the second curved surface goes away from the nipple portion; and a base portion formed on the nipple body portion, wherein the base portion is capable of being attached to a container to accommodate a drink, wherein the nipple body portion has a maximum outer diameter of 30 mm or more, and wherein the nipple portion is composed of an elastic material having a Durometer A hardness of 5 to 25, and wherein the nipple portion has a thickness in the direction of the center thereof, at the maximum outer diameter portion of the nipple portion, of 1.5 mm or more.

* * * * *